United States Patent [19]

Toffolon

[11] Patent Number: 4,474,400

[45] Date of Patent: Oct. 2, 1984

[54] LIFTING DEVICE FOR MASSIVE PRECAST CONCRETE WALL UNITS

[76] Inventor: Roger L. Toffolon, 953 MacArthur Blvd., SE., Stuart, Fla. 33494

[21] Appl. No.: 402,105

[22] Filed: Jul. 26, 1982

Related U.S. Application Data

[63] Continuation-in-part of Ser. No. 349,058, Feb. 16, 1982, abandoned.

[51] Int. Cl.[3] ..... B66C 1/44

[52] U.S. Cl. ..... 294/97

[58] Field of Search ..... 294/97, 95, 93, 94, 294/79, 80, 86.24, 86.25, 87.18

[56] References Cited

U.S. PATENT DOCUMENTS

| | | | |
|---|---|---|---|
| 2,370,482 | 2/1945 | Morgan et al. | 294/97 |
| 2,670,233 | 2/1954 | Barchoff | 294/97 |
| 4,300,382 | 11/1971 | Meek | 294/97 |

*Primary Examiner*—James B. Marbert

*Attorney, Agent, or Firm*—McCormick, Paulding & Huber

[57] ABSTRACT

A lifting device for massive precast concrete wall units having spaced parallel front and rear wall panels and spaced apart lateral connecting arms therebetween. The device comprises a pair of pivotally connected lifting legs swingable between retracted and expanded positions. The legs have a spreader element pivotally connected therebetween intermediate their ends. At upper ends a pair of connecting links are respectively connected pivotally at lower ends with the legs and pivotally connected together at upper ends. A lift attachment is also pivotally connected at upper ends of the connecting links. At lower ends the legs have fixed or pivotal shoes with outwardly projecting toes which engage beneath the bottom surfaces of the arms of the wall units with the legs expanded. With the legs retracted the legs and shoes are freely moveable vertically between the arms of the wall units. Shoes are selectively mountable on the legs in pairs with horizontal and at least one other toe angle. A manually operable locking mechanism secures the legs in retracted position in an overcenter position and, when released, the legs assume their expanded position at the urging of gravity.

10 Claims, 9 Drawing Figures

LIFTING DEVICE FOR MASSIVE PRECAST CONCRETE WALL UNITS

CROSS REFERENCE TO RELATED APPLICATION

This application is a continuation-in-part of my copending U.S. application Ser. No. 349,058 entitled Lifting Device for Massive Precast Concrete Wall Units, filed Feb. 16, 1982, now abandoned.

BACKGROUND OF THE INVENTION

Modular retaining walls comprising a number of stacked precast concrete units now enjoy commercial acceptance. The leading commercial unit is disclosed in U.S. patent application Ser. No. 204,327 entitled Improved Precast Concrete Structural Unit and Composite Wall Structure filed Nov. 4, 1980 by Roger L. Toffolon and William L. Brown.

The precast modular units are massive in form and handling of the same raises significant problems. That is, the units must be transported, for example as by flat bed trailer, removed in succession from the trailer and carefully stacked in the construction of a retaining wall or the like. Efficient lifting and transporting apparatus for the individual modules or units has heretofore been unavailable.

Accordingly, it is the general object of the present invention to provide a lifting device for massive precast concrete units having spaced parallel front and rear wall panels and spaced apart lateral connecting arms therebetween, the device being readily engageable with and disengageable from the units in a convenient and efficient lifting and transporting operation of the units.

SUMMARY OF THE INVENTION

In fulfillment of the foregoing object and in accordance with the present invention, a lifting device is provided and is particularly adapted to precast concrete wall units having spaced parallel front and rear wall panels and a pair of spaced apart lateral connecting arms therebetween. That is, the lifting device is designed to lift, transport, and efficiently deposit the units as, for example, from a flat bed trailer to a selected position on a retaining wall. The device enters the units vertically between their connecting arms in a retracted position and, on expansion and engagement with bottom surfaces of the arms, the lifting device serves to secure and balance a unit for vertical and other movement. The device is also capable of precise positioning of a unit atop a similar unit or units in a retaining wall in horizontal and in other attitudes of deposition.

The lifting device comprises a pair of pivotally connected lifting legs swingable between retracted and expanded positions. Lower end portions of the legs in the retracted position have an overall horizontal dimension such that the legs can freely pass vertically between the arms of a precast concrete wall unit of the type described. In expanded position of the legs the lower end portions have an overall horizontal dimension such that they reside respectively in close proximity to the inner walls of the connecting arms of a precast concrete wall unit. A pair of shoes respectively mountable on lower end portions of the legs have opposite laterally outwardly projecting toe portions which are adapted respectively to engage bottom surfaces of the arms of a precast concrete wall unit with the legs of the lifting device in the expanded position. The unit is thus securely held and balanced for lifting and transport as desired.

The lifting device also includes a manually operable locking mechanism which has lock and release positions respectively for securing the legs of the device in their retracted position and for freeing the legs for movement to their expanded position. In the preferred embodiment shown, the legs move to the expanded position at the urging of gravity and are retained in such position during lifting and transport of a concrete wall unit by the orientation of forces exerted thereon.

The lifting device also includes a lift attachment which is connected with the legs at upper end portions for releasably securing a vertically moveable power hoist to the lifting device. Any suitable hoist means may be employed with the lifting device of the present invention.

In its preferred form and as illustrated in the drawings, the lifting device includes a spreader element pivotally connected with the legs intermediate their ends. At upper end portions the legs have a pair of operatively associated connecting links, each pivotally attached to its leg and extending to a common pivotal connection with the lift attachment. The aforementioned manually operable locking mechanism is disposed between the lifting legs above the spreader element and below their connection with the connecting links. An overcenter operation of the mechanism is provided for convenient manual manipulation securing the legs in their retracted position. On release of the locking mechanism, the legs freely swing to their expanded position as described.

Provision is made for the deposition of the wall units in a horizontal attitude and at other angles of inclination by employing a plurality of pairs of shoes selectively mountable in pairs at lower end portions of the lifting legs. That is, shoes are provided for holding wall units in a horizontal attitude and when desired, a pair of horizontal shoes may be removed from the lifting legs and replaced with a similar pair of shoes having toes at angles which depart from the horizontal. The toes may have a slight angle of inclination as required to construct an inclined retaining wall of the type known in the trade as a "batter" or "battered" wall. The inclined toes on the shoes lift and transport the wall units at a slight angle of inclination, front wall to rear wall, and the units are so stacked in the construction of the retaining wall. Obviously, pairs of shoes having toes with various angles of inclination may be provided for selective use on the legs of the lifting device. Similarly, the length of the shoe elements may vary in accordance with the size or vertical dimension of precast concrete wall units to be handled thereby.

PREFERRED EMBODIMENTS

Figure 1:
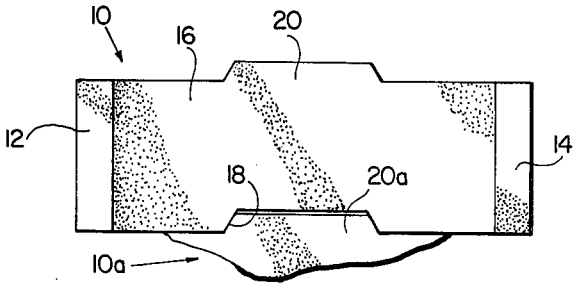
FIG. 1 is an end view of a precast concrete wall unit of the type handled by the lifting device of the present invention, a portion of a subadjacent unit being shown therebeneath.
Figure 2:
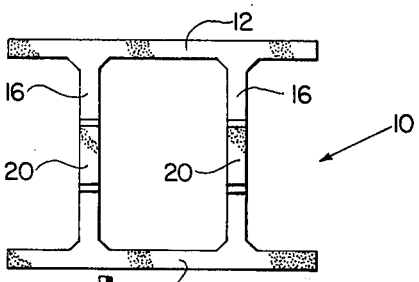
FIG. 2 is a top view of a precast concrete wall unit of the type shown in FIG. 1, but at a somewhat reduced scale.

Referring particularly to FIGS. 1 and 2, a precast concrete wall unit indicated generally at 10 has front and rear wall panels 12,14. The wall panels 12,14 are spaced apart and in parallel relationship and have integral connecting arms 16,16. The connecting arms 16,16 are spaced apart laterally and in parallel relationship and include a mortise-tenon 18,20 for the interconnection of vertically stacked wall units. That is, a portion of a subadjacent wall unit 10*a* in FIG. 1 has its tenon 20*a* entered in the mortise 18 at a lower surface of the connecting arm 16 shown therein.

Precast wall units such as 10,10*a* may of course be stacked in various configurations to form composite wall structure such as retaining walls and reference may be had to the aforementioned patent application for further description and illustration of the modular wall units and composite walls. As mentioned above, the wall units may be removed, as for example from a flat bed trailer, transported to an adjacent wall site and successively stacked in a precisely vertical or "battered" attitude.

Figure 3:
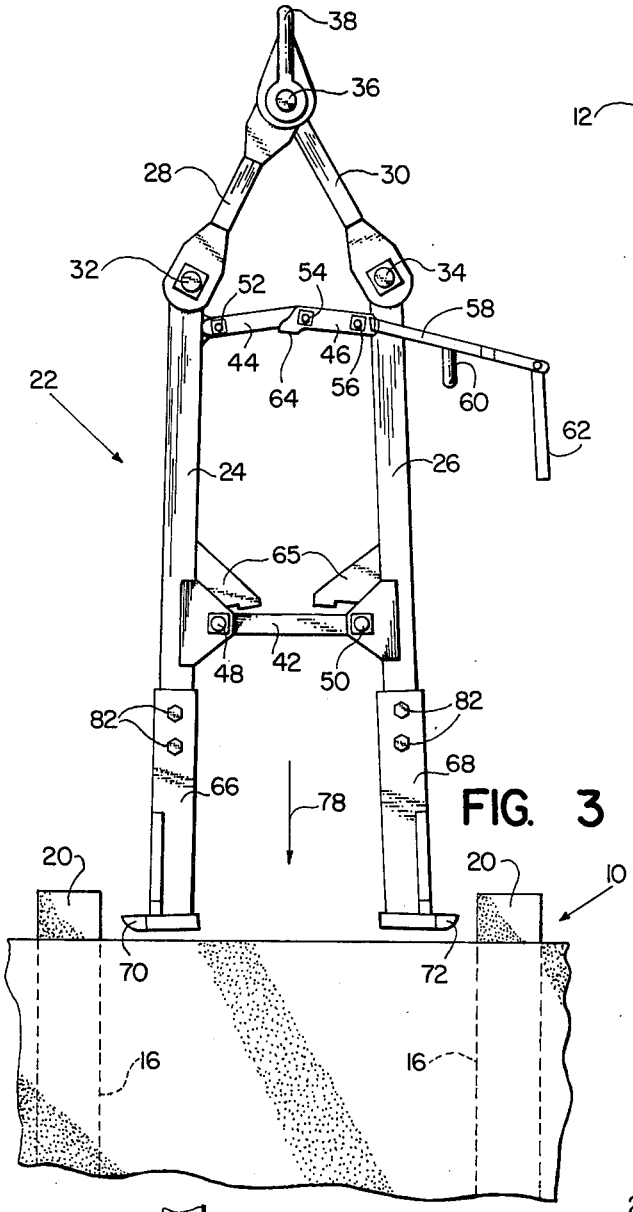
FIG. 3 is a side view of the lifting device of the present invention in a retracted position and elevated slightly above a portion of a precast concrete wall unit.
Figure 4:
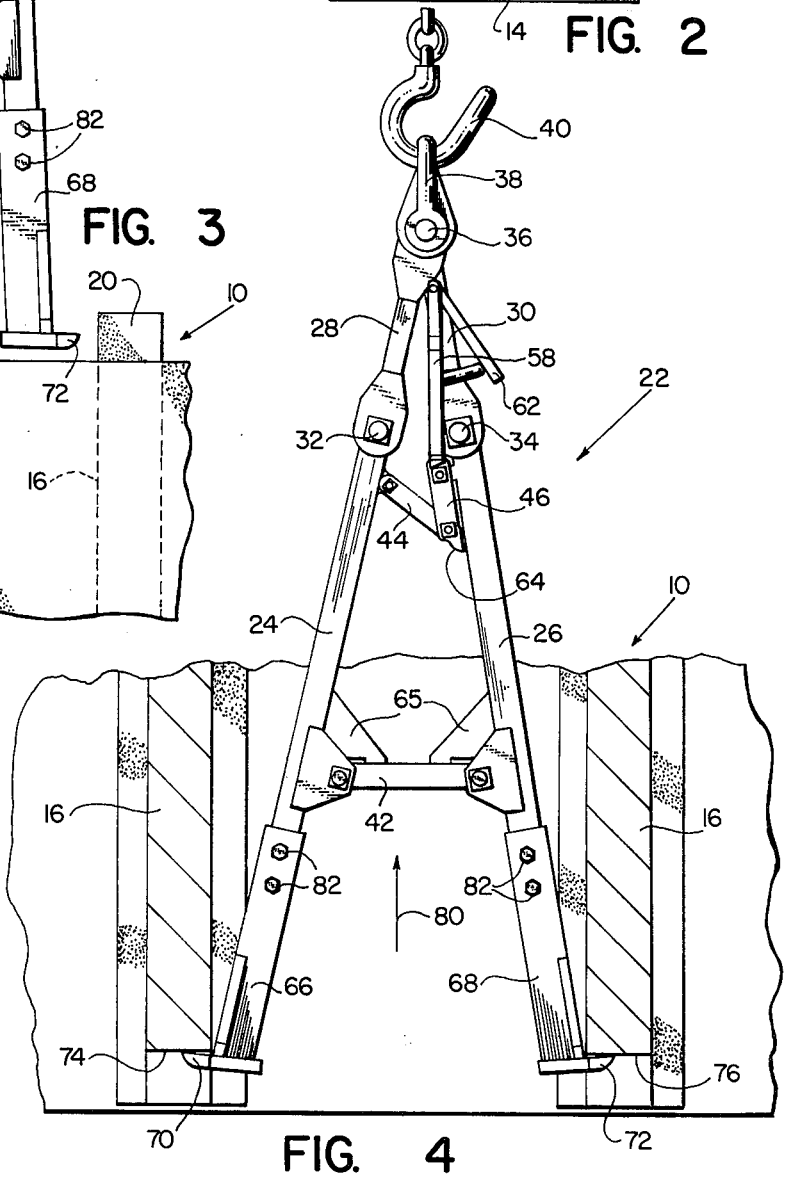
FIG. 4 is a side view of the lifting device of the present invention in an expanded position and with its shoes in engagement with bottom surfaces of connecting arms of a wall unit, partially shown in section.

A lifting device constructed in accordance with the present invention and indicated generally at 22 in FIGS. 3 and 4 includes a pair of similar pivotally connected lifting legs 24,26. As illustrated, the lifting legs 24,26 are indirectly pivotally connected by means of a pair of connecting links 28,30 but other pivotal connections are contemplated, as for example, a direct pivotal connection between the legs.

Figure 6:
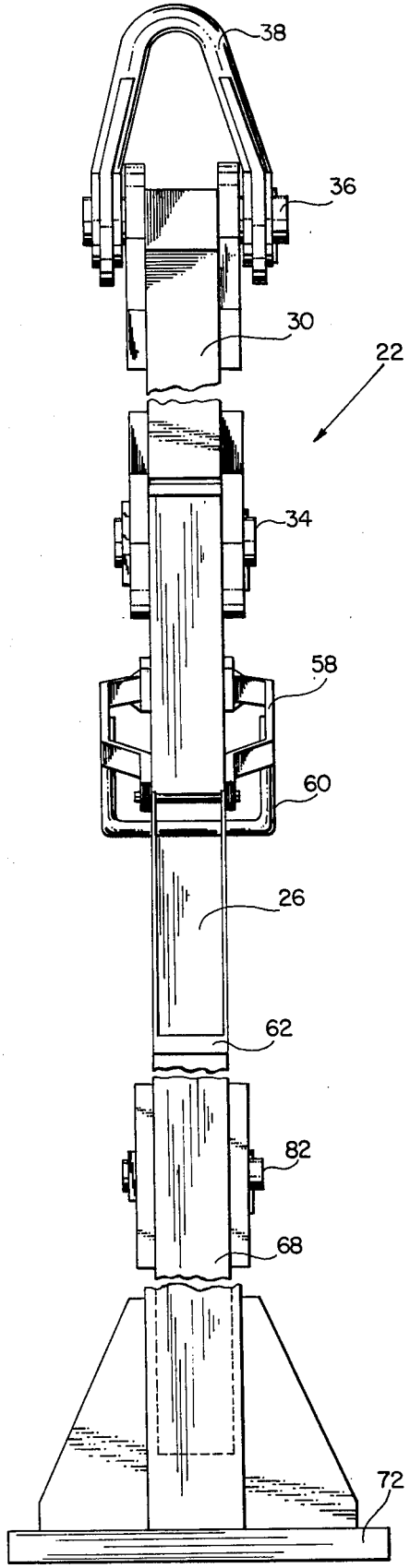
FIG. 6 is an enlarged right hand side view of the lifting device of FIGS. 3 and 4.
Figure 7:
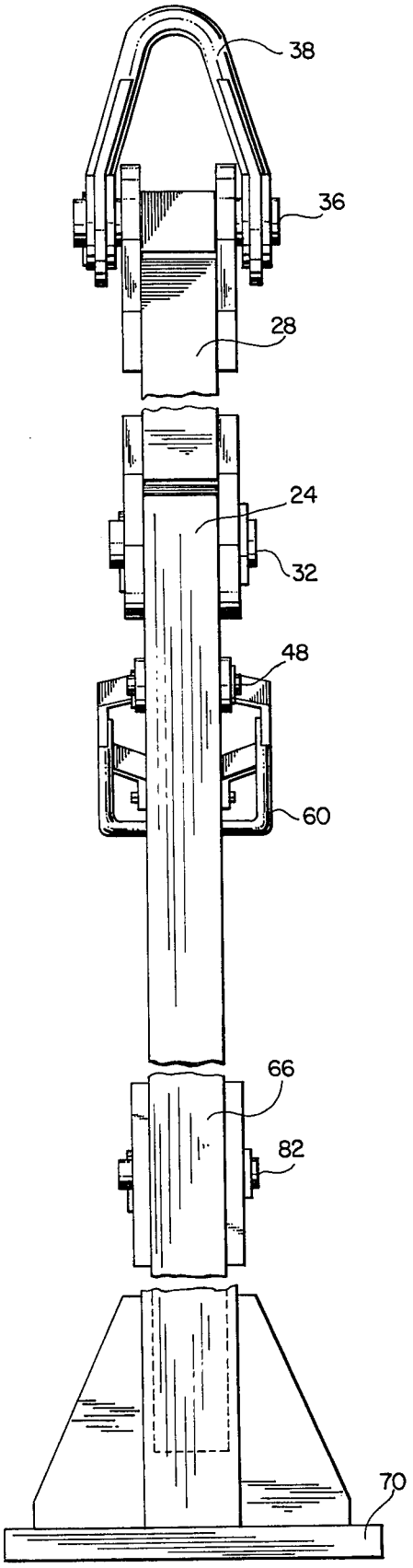
FIG. 7 is an enlarged left hand side view of the lifting device.

The connecting links 28,30 have pivotal connections respectively with pivot pins 32,34 at lower end portions and a common pivotal connection at upper end portions with a pivot pin 36. The pivot pin 36, as best illustrated in FIGS. 6 and 7, connects the links 28 and 30 together and also pivotally connects a lift attachment 38. The lift attachment 38 takes the form of a generally U-shaped member in an inverted position and with its depending legs pivotally engaged with the pin 36, FIGS. 6, 7. A wide variety of power hoist means can thus be readily attached to the lifting device as for example a hook member 40 in FIG. 4 which may depend from a construction crane. With a crane disposed adjacent a flat bed trailer and a retaining wall site, wall units may be readily lifted from the trailer and deposited in their desired position in a base or succeeding course of units in order to construct a composite wall structure.

As illustrated in FIG. 3 and in their retracted position, the lifting legs 24,26 depend generally vertically from the pivot pins 32,34. They are held in such position by a spreader element 42 and a locking mechanism comprising the links 44,46. The spreader element 42 is pivotally connected at a left hand end portion at 48 with the left hand lifting leg 24 and at a right hand end portion at 50 with the right hand lifting leg 26.

The locking mechanism comprising the links 44,46 is adapted for manual operation and for lock and release positions respectively for securing the legs 24,26 in their retracted position and for freeing the legs for movement to their expanded position, FIG. 4. Link 44 has a pivotal connection at 52 with the left hand leg 24 and a pivotal connection at 54 with the link 46. At its right hand end the link 46 has a pivotal connection 56 with the right hand lifting leg 26. A bifurcated handle 58 is rigidly connected with the link 46 as by welding and extends rightwardly in FIGS. 3–4 for manual operation of the locking mechanism. Two generally U-shaped members 60,62 depend from the handle 58, FIGS. 6–7 for ease and convenience of manual manipulation.

With the locking mechanism positioned as shown in FIG. 3 a small horizontal stop member 64 at an inner end of the link 46 engages the link 44 to limit the central upward swinging movement of both links 44,46 in an overcenter position as illustrated. Thus, the links 44,46 serve as a second spreader element at an upper portion of the lifting legs 24,26 and retain the legs in the retracted position shown in FIG. 3.

When the handle 58 is swung upwardly as illustrated in FIG. 4 whereby to pivot the link 46 downwardly the link 44 is similarly swung downwardly to allow the legs 24,26 to swing inwardly at upper end portions and outwardly at lower end portions to the FIG. 4 position. The legs swing at the urging of gravity once the links 44,46 pass the horizontal in their downward swinging movement. That is, the weight and geometrical configuration of the legs and the various links is such as to cause the legs to assume the FIG. 4 position with the links 28,30 extending upwardly therefrom and forming a continuation or an apex of a generally V-shaped configuration. It will be noted that the leg 24 and the link 28 reside substantially in linear relationship as do the leg 26 and the link 30. Thus, any upwardly exerted force on the lift attachment 38 is exerted linearly through the links and legs to the lowermost portions of the legs.

Preferably, an abutment means is provided for limiting the movement of the legs 24,26 toward their expanded position and for establishing the V-shaped configuration of FIG. 4. As best illustrated in FIG. 4, a pair of stop members 65,65 are provided respectively on the legs 24,26 and when the legs 24,26 assume the desired V-shaped configuration the stop members 65,65 engage the spreader member 42 whereby to limit swinging movement of the legs. Similarly, the small horizontal member 64 on the link 46 may engage the leg 26. With the lifting device in the FIG. 4 position, and prior to engagement and lifting of a wall unit, the stops 65,65 serve to prevent free or unintended movement about the pivot pins 32,34 as might cause one leg to depart slightly from the desired V-configuration. That is, the lowermost portion of one leg might be slightly higher than the other and there may be a tendency for free individual swinging movement of the legs about their pivot pins making engagement of the lifting device with the wall unit difficult. Once the lifting device is engaged with the wall unit as shown in FIG. 4 and an upward force is exerted at the lift attachment 38, the legs and their connecting links will remain in linear relationship due to the linear forces exerted thereon and the stops 65,65 may be unnecessary in this phase of operation.

The engagement of the lifting device with the wall units for lifting and transporting the units is provided for by a pair of shoes 66,68 mounted respectively at lower end portions of the legs 24,26. As best shown in FIGS. 3 and 4, the shoes 66,68 have oppositely laterally outwardly projecting toe portions 70,72 which engage bottom surfaces 74,76 of the arms 16,16 of a wall unit in FIG. 4. More specifically, the toes 70,72 engage bottom surfaces 74,76 of the mortises formed at the bottom of the walls 16,16 as in FIG. 1. With the toes 70,72 in engagement with the surfaces 74,76, the wall unit is balanced and supported for lifting and transport by the lifting device of the present invention. If, for example, the wall unit is to be removed from a flat bed trailer and stacked in the construction of a retaining wall, the lifting device is lowered vertically in the direction of the arrow 78 in FIG. 3 between arms 16,16 of a wall unit. The lifting device is of course in its retracted position during free vertical movement between the arms 16,16 and when the locking mechanism is moved to the FIG. 4 position, the lifting device may be engaged with the wall unit as shown in FIG. 4. Lifting of the wall unit may then be effected in the direction of the arrow 80 in FIG. 4 and the unit may be positioned as desired in the stacking and construction of the retaining wall. Re-engagement of the locking mechanism moving the same to the FIG. 3 position allows the lifting device to be withdrawn upwardly from between the arms 16,16 of the wall unit and a next succeeding wall unit may then be engaged on the trailer for transport to the wall.

The shoes 66,68 in FIGS. 3 and 4 have tubular upper portions which are telescopically received by lower end portions of the lifting legs 24,26 and which may be removably secured in position by means of suitable bolts 82,82. Thus, it will be apparent that shoes can be provided in pairs for selective mounting on the legs 24,26 of the lifting device. The shoes 66,68 shown in FIGS. 3,4,6 and 7 have horizontal toes or toe plates 70,72 and thus serve to balance a wall unit in a horizontal position or attitude when the lifting device is engaged with the unit.

Figure 5:
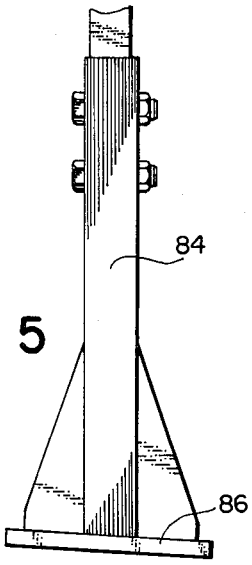
FIG. 5 is a fragmentary view of a leg of the lifting device with a shoe mounted thereon having a toe at a slight angle of inclination.

Similarly, a shoe such as illustrated in FIG. 5 at 84 may be provided with a toe 86 which is inclined slightly from the horizontal. When a pair of such shoes are mounted on the legs 24,26 they provide for a corresponding inclination of a wall unit supported by the lifting device. That is, a wall unit such as the unit 10 shown in FIGS. 1 and 2 may be inclined slightly downwardly from front to rear and the wall may be so constructed. Such a wall, known in the trade as a "batter" or "battered" wall as mentioned, is stacked at a slight angle of inclination from the horizontal whereby to provide a wall that is inclined slightly from the vertical. The angle may only be a few degrees but it is nevertheless important to deposit the wall units efficiently atop one another at the desired angle of inclination. Accordingly, a horizontal toe such as the toes 70,72 may create a cumbersome situation in attempting to deposit a wall unit supported horizontally atop a wall unit which is slightly inclined from the horizontal. On the other hand, with inclined toes such as the toe 86, the operation can be carried out with a high degree of efficiency.

Figure 8:
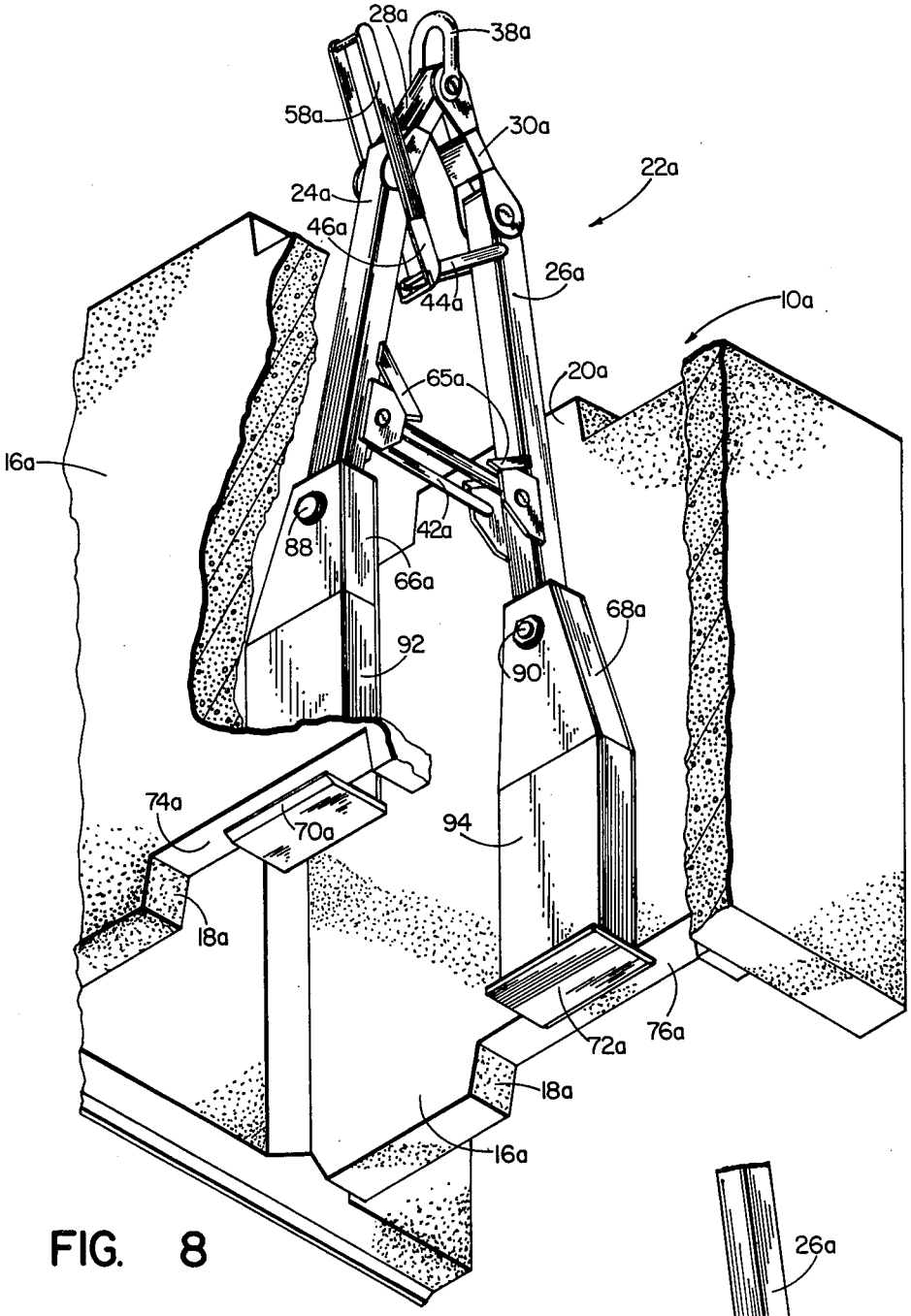
FIG. 8 is a perspective view of a lifting device forming a second embodiment of the present invention, the device being shown in engagement with and supporting a wall unit which is partially broken away for clarity of illustration.
Figure 9:
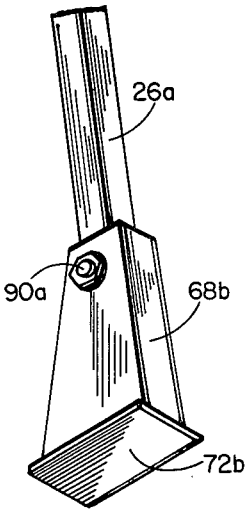
FIG. 9 is a fragmentary perspective view showing a portion of one leg of a lifting device similar to the lifting device of FIG. 8 but adapted for a smaller wall unit.

A lifting device **22*a* shown in FIGS. 8 and 9 forms a second embodiment of the present invention and may be substantially identical with the lifting device described above except for the shoes 66*a* and 68*a*. That is, the lifting device 22*a* includes lifting legs 24*a*,26*a* supported by connecting links 28*a* and 30*a*, a locking mechanism 44*a*, 46*a* having a handle 58*a* and a spreader 42*a* disposed beneath the locking mechanism and between the lifting legs. The device may be attached to a power hoist or the like for lifting and transport of precast concrete wall units such as 10*a* by means of a lift attachment 38*a*. The precast concrete wall unit 10*a* is shown broken away for clarity but may be regarded as identical with the wall unit 10** above.

The shoes **66*a* and 68*a* are similar to the shoes described above but are provided with a pivotal connection with their respective lifting legs 24*a* and 26*a*. Thus, pivot pins 88 and 90 interconnect the lifting legs and the shoes and the shoes are freely swingable about the pivot pins relative to the lifting legs. In FIG. 8, the shoe 66*a* includes an extension element 92 fixedly connected to the shoe and having a toe plate 70*a* fixedly connected at its lower end portion. Similarly, an extension 94 is fixed to the shoe 68*a* and carries a toe plate 72*a* at its lower end portion. The toe plates 70*a*,72*a* engage bottom surfaces 74*a* and 76*a* respectively at mortises 18*a*,18*a* in connecting arms 16*a*,16*a* of the wall unit 10*a***.

The pivotal connection of the shoes **66*a* and 68*a* provides for an important improvement in the operation of the lifting device. With the fixed shoes and toe plates of the lifting device of FIGS. 1–7, a precast unit supported thereby may be tilted relative to the toe plates as it is deposited on a retaining wall. That is, with either a vertical or a battered wall, and more particularly with the latter, the power hoist associated with the lifting device may lower the device and a precast unit held thereby so that the lower surfaces of the unit are not precisely in horizontal or inclined registry with a subadjacent wall unit. For example, a front wall of a descending wall unit may engage the front wall of a subadjacent unit slightly before the engagement between the rear walls of the unit occurs. This may result in a slight tilting of the descending unit such that surfaces 74,76 may be displaced slightly relative to the toe plates 70,72. Further, this may result in line rather than plane contact between the toe plates and the surfaces 74,76 and may even result in damage to the surfaces 74,76** and rupture of adjacent concrete areas.

The foregoing functional or operational difficulties are completely overcome with the pivotally attached shoes **66*a*,68*a* of FIG. 8. In the event of a slight misalignment of a descending wall unit such as 10*a* and a subadjacent wall unit in a retaining wall, the unit 10*a* may for example make initial contact with the subadjacent unit at its front wall. The shoes 66*a*,68*a* thereupon pivot slightly allowing the toe plates 70*a*,72*a* to remain in firm planar contact at all times with the surfaces 74*a*,76*a*. Thus, the wall unit is deposited gently atop the subadjacent unit and damage to the surfaces 74,76** is avoided with potential rupture of adjacent areas positively prevented.

The shoes **68*b* in FIG. 9 is substantially identical with the shoe 68*a* of FIG. 8 except for the provision of toe plate 72*b* immediately at the lower surface thereof. That is, the extension 94 is eliminated in FIG. 9 with the shoe 68*b* adapted for pivotal movement relative to leg 26*a* through the provision of pivot pin 98. As will be apparent, the shoe 68*b* is employed with wall units having a somewhat lesser vertical dimension than the wall unit 10*a*. Similarly, a plurality of extensions 92,94 may be provided in pairs for wall units of varying height. The extensions 92,94 are adapted for selective connection with the shoes 66*a*,68*a* and each such extension carries a toe plate 70***a*,72*a*. In all cases the necessary pivotal or slight swinging movement of the shoes and extensions is provided for by the pivotal connection between the shoes and their respective lifting legs.

In view of the foregoing, it will be apparent that it is within the scope of the present invention to provide a plurality of pairs of shoes selectively mountable on the legs of a lifting device of the invention. The shoes are of course mounted in pairs and may have horizontal toes, toes at a slight angle of inclination, or, other variations in shoe and toe design such as pivotal shoes may be accommodated. Further, shoes of varying length may be desirable for handling wall units of varying vertical dimension.

It will be apparent that a novel lifting device has been provided in accordance with the present invention. The device is particularly adapted for efficient use with precast concrete wall units of the type described and provides for a rapid and efficient operation in the lifting and transporting of the wall units. The device is yet simple in concept and construction and exhibits a high degree of durability an dependability in use.

I claim:

1. A device for lifting and transporting massive precast concrete wall units having spaced parallel front and rear wall panels and spaced apart lateral connecting arms therebetween; said device comprising a pair of pivotally connected lifting legs swingable between retracted and expanded positions, lower end portions of the legs in the retracted position of the legs having an overall horizontal dimension such that the legs can freely pass vertically between the arms of a precast concrete wall unit, and said lower end portions of the legs having an overall horizontal dimension in the expanded position of the legs such that the end portions reside respectively in close proximity to the inner walls of the arms of a precast concrete wall unit, at least one pair of shoes respectively mountable on said lower end portions of said legs and having oppositely laterally outwardly projecting toe portions adapted respectively to engage bottom surfaces of the arms of a precast concrete wall unit with the legs of the lifting device in the expanded position, a manually operable locking mechanism having lock and release positions respectively for securing the legs in their retracted position and for freeing the legs for movement to their expanded position, a lift attachment for releasably securing a vertically movable power hoist to the lifting device for lifting and transporting precast concrete wall units with the device, a pair of connecting links respectively for pivotal connection at lower ends with upper end portions of said legs and at upper ends with said lift attachment and with each other, and a spreader element intermediate the ends of and between said legs, said legs being pivotally attached to said spreader element for movement between their retracted and expanded positions, said legs taking a generally V-shaped configuration with the connecting links forming a rectilinear continuation of the legs and completing the apex of the V-shape at an upper end portion when the legs are in their expanded position.

2. A device for lifting and transporting massive precast concrete wall units as set forth in claim 1 wherein said shoes are adapted to be pivotally mounted respectively on said lower end portions of the legs for front-to-rear pivotal movement of wall units supported thereby.

3. A device for lifting and transporting massive precast concrete wall units as set forth in claim 2 wherein a plurality of pairs of shoes of varying length are provided, said shoes being selectively mountable in pairs respectively on said legs of said lifting device.

4. A device for lifting and transporting massive precast concrete wall units as set forth in claim 1 wherein a plurality of pairs of shoes is provided in pairs with a horizontal and at least one other toe angle for engagement with bottom surfaces of the arms of precast wall units, said shoes being selectively mountable in pairs respectively on said legs of said lifting device.

5. A device for lifting and transporting massive precast concrete wall units as set forth in claim 1 wherein the pivotal connection of said legs is such that the legs assume their expanded position at the urging of gravity on release of said locking mechanism.

6. A device for lifting and transporting massive precast concrete wall units as set forth in claim 1 wherein said legs assume approximately a parallel relationship in their retracted position.

7. A device for lifting and transporting massive precast concrete wall units as set forth in claim 1 wherein abutment means is provided limiting movements of said legs toward their expanded position and for establishing said generally V-shaped configuration.

8. A device for lifting and transporting massive precast concrete wall units as set forth in claim 7 wherein said abutment means takes the form of a pair of stop members respectively on said legs and engageable with said spreader element on movement of said legs toward their expanded position.

9. A device for lifting and transporting massive precast concrete wall units as set forth in claim 7 wherein said locking mechanism takes the form of a pair of pivotally interconnected links between said legs and having remote end portion respectively pivotally connected with the legs, said links having an overcenter lock position and a release position for free pivotal movement thereof and for free swinging movement of the legs to their expanded position.

10. A device for lifting and transporting massive precast concrete wall units as set forth in claim 7 wherein said lift attachment takes the form of an inverted generally U-shaped member with free end portions of its legs pivotally connected in common with upper end portions of said connecting links.

* * * * *